US006272996B1

(12) United States Patent
O'Brien et al.

(10) Patent No.: US 6,272,996 B1
(45) Date of Patent: Aug. 14, 2001

(54) IN-LINE INITIATOR AND FIRING DEVICE ASSEMBLY

(75) Inventors: John P. O'Brien, Pawcatuck; Stephen W. Bartholomew, Simsbury, both of CT (US)

(73) Assignee: Shock Tube Systems, Inc., Charlestown, RI (US)

( * ) Notice: Subject to any disclaimer, the term of this patent is extended or adjusted under 35 U.S.C. 154(b) by 0 days.

(21) Appl. No.: 09/406,889

(22) Filed: Sep. 28, 1999

Related U.S. Application Data

(60) Provisional application No. 60/103,342, filed on Oct. 7, 1998.

(51) Int. Cl.[7] ..... C06C 5/06; C06C 5/00

(52) U.S. Cl. ..... 102/275.11; 102/275.1

(58) Field of Search ..... 102/275.2, 275.3, 102/275.4, 275.6, 275.7, 275.8, 275.11

(56) References Cited

U.S. PATENT DOCUMENTS

| | | | |
|---|---|---|---|
| 3,260,202 | 7/1966 | Bryla . | |
| 3,411,401 | 11/1968 | Harris . | |
| 3,590,739 | 7/1971 | Persson . | |
| 3,678,853 | 7/1972 | Kilmer . | |
| 3,724,383 | 4/1973 | Gallaghan et al. . | |
| 3,792,660 | 2/1974 | Plumer . | |
| 3,990,728 | 11/1976 | Coughlin . | |
| 4,272,102 | 6/1981 | Burkdoll . | |
| 4,328,753 | 5/1982 | Kristensen et al. . | |
| 4,660,472 | 4/1987 | Stevens . | |
| 4,757,764 | 7/1988 | Thureson et al. . | |
| 4,759,291 | 7/1988 | Barker et al. . | |
| 4,957,027 | 9/1990 | Cherry . | |
| 5,012,741 | 5/1991 | Peebles et al. . | |
| 5,169,179 | 12/1992 | Teel, Sr. et al. . | |
| 5,327,835 | 7/1994 | Adams et al. . | |
| 5,365,851 | 11/1994 | Shaw . | |
| 5,417,162 | 5/1995 | Adams et al. . | |
| 5,597,973 | 1/1997 | Gladden et al. . | |
| 5,614,693 | 3/1997 | Welch . | |
| 6,006,671 | * 12/1999 | Yunan | 102/275.11 |

* cited by examiner

*Primary Examiner*—Charles T. Jordan
*Assistant Examiner*—Nicholas W DiCostanzo
(74) *Attorney, Agent, or Firm*—McCormick, Paulding & Huber LLP

(57) ABSTRACT

An in-line initiator and firing device assembly includes a shock tube assembly. An in-line initiator is provided for initiating a shock wave along the shock tube assembly, and includes an end sleeve having a bore extending between input and output ends. At least a portion of a surface defining the bore toward the output end of the end sleeve is threaded for threadably receiving and forming threads on an outer surface of the input end of the shock tube assembly. A first retaining device is associated with the end sleeve for receiving a shock wave triggering device and securing the triggering device to the input end of the end sleeve. A firing device assembly is activated by a shock wave transmitted through the shock tube assembly. The firing device includes a barrel having a bore extending between input and output ends. The input end of the barrel communicates with the output end of the shock tube assembly and the output end communicates with a firing device. A firing pin piston is movably disposed within the bore of the barrel, and defines a cavity communicating with the input end of the barrel for storing a propellant charge to be initiated by shock waves transmitted from the shock tube assembly. A second retaining device is associated with the barrel for coupling the firing device to the barrel.

23 Claims, 6 Drawing Sheets

IN-LINE INITIATOR AND FIRING DEVICE ASSEMBLY

CROSS REFERENCE TO RELATED APPLICATION

This application claims the benefit of U.S. Provisional Application 60/103,342, filed Oct. 7, 1998.

FIELD OF THE INVENTION

The present invention relates generally to a firing device, and more particularly to an in-line initiator and firing device assembly for use with a shock tube to propagate a percussive signal for firing a remote charge.

An improved output device for firing is also disclosed.

BACKGROUND OF THE INVENTION

U.S. Pat. No. 5,012,741 to Peebles et al. shows an initiator for a transmission tube comprising a body having a passageway formed therein for retaining an initiator charge and a holder formed within the body for receiving a signal transmission tube and holding a side of the transmission tube in proximity to the initiator charge whereby, upon detonation of the initiator charge, a signal is initiated in the transmission tube through the side of the tube. A primer charge 33 ignites a delay column composition 45 which in turn ignites an initiator charge 41 which pierces the signal transmission tube thereby initiating signal propagation in the tube. While this initiator, by initiating through the tube, maintains the tube sealed against the environment until the moment of initiation, it requires a charge of sufficient strength to rupture the initiation tube.

U.S. Pat. No. 5,365,851 to Shaw shows an initiation fixture for an impulse transmission tube consisting of a sleeve 30 having a longitudinal bore dimensioned and configured to receive a shock tube 10 in one end and a primer cap 28 in the other end. The primer cap 28 and the end of the shock tube 10 are separated by an intervening isolation member 34 which disperses static electricity. The initiation fixture is attached to the shock tube by crimping the sleeve around a closure bushing 36 and optionally provides a stop member 26 to limit the travel of the retaining device 40. Crimping the initiation fixture onto the shock tube 10 restricts the interior diameter of the shock tube and can lead to failures in igniting the transmission tube.

U.S. Pat. No. 4,272,102 to Burkdoll shows a device for coupling an ignitive reaction or percussive shock wave to a relatively moveable body member such as an airbag mounted on the steering wheel of an automobile. Impact sensors 16 located on the front of the vehicle 11 will initiate shock tube transmission lines 17–19. These shock tube transmission lines will transmit a percussive signal to a gas generator that will inflate an airbag.

U.S. Pat. No. 4,957,027 shows a nonelectric disarmer that uses small arms cartridges that can employ various types of destructive projectiles including water, clay, shot and steel slugs. The force of the shock wave in the shock tube 26 will forcibly strip the piston 50 from the threaded stud 54 attached to the shock tube. The piston is then accelerated down a barrel assembly 52 to fire a primer 34 on small arms cartridge 30. However, due to the relatively small internal volume of the shock tube, the amount of work energy available from the reaction in the tube is relatively weak so as to limit the effectiveness of such a device.

In view of the foregoing, it is an object of the present invention to provide an in-line initiator and firing device assembly which overcomes the above-mentioned drawbacks and disadvantages to more efficiently provide a percussive signal to a remote charge.

SUMMARY OF THE INVENTION

According to a first aspect of the present invention, an initiator device for generating a shock wave through a shock tube includes an end sleeve having an inner surface defining a bore extending between input and output ends. At least a portion of the inner surface of the end sleeve toward the output end is threaded for threadably receiving and forming threads on an outer surface of a shock tube received within the output end. Retaining means are associated with the sleeve for receiving a triggering device for initiating a shock wave and securing the device to the input end of the end sleeve.

According to a second aspect of the present invention, a firing device assembly for receiving a shock wave from a shock tube includes a barrel having an inner surface defining a bore extending between input and output ends. The input end of the barrel is for communicating with a shock tube and the output end is for communicating with a firing device. A firing pin piston is movably disposed within the bore of the barrel, and defines a cavity communicating with the input end of the barrel for storing a propellant charge to be initiated by shock waves from the shock tube. Retaining means is associated with the barrel for coupling the firing device to the barrel.

According to a third aspect of the present invention an in-line initiator and firing device assembly includes a shock tube assembly having an input end and an output end. An in-line initiator is provided for initiating a shock wave along the shock tube assembly. The in-line initiator includes an end sleeve having an inner surface defining a bore extending between input and output ends. At least a portion of the inner surface of the end sleeve toward the output end is threaded and threadably receives and forms threads on an outer surface of the input end of the shock tube assembly. First retaining means is associated with the end sleeve for receiving a shock wave triggering device and securing the triggering device to the input end of the end sleeve. A firing device assembly is provided for being activated by a shock wave transmitted through the shock tube assembly. The firing device includes a barrel having an inner surface defining a bore extending between input and output ends. The input end of the barrel communicates with the output end of the shock tube assembly and the output end communicates with a firing device. A firing pin piston is movably disposed within the bore of the barrel, and defines a cavity communicating with the input end of the barrel for storing a propellant charge to be initiated by shock waves transmitted from the shock tube assembly. Second retaining means is associated with the barrel for coupling the firing device to the barrel.

Preferably, heat shrinkable tubing is applied to the shock tube assembly where it interfaces with the in-line initiator or the firing device to provide reinforcement. Further, heat shrinkable tubing preferably covers the interface of the shock tube assembly with the in-line initiator or the firing device to provide a seal against moisture infiltration.

An advantage of the present invention is that the in-line initiator and firing device is sealed at both ends to prevent moisture infiltration.

Another advantage of the present invention is that the shock tube assembly is coupled to the in-line initiator and firing device without crimping the shock tube assembly which would otherwise impede shock wave propagation.

Other advantages of the present invention will be made apparent in the following description and accompanying drawings.

DETAILED DESCRIPTION OF THE IN-LINE INITIATOR (FIGS. 1 AND 2)

Figure 1:
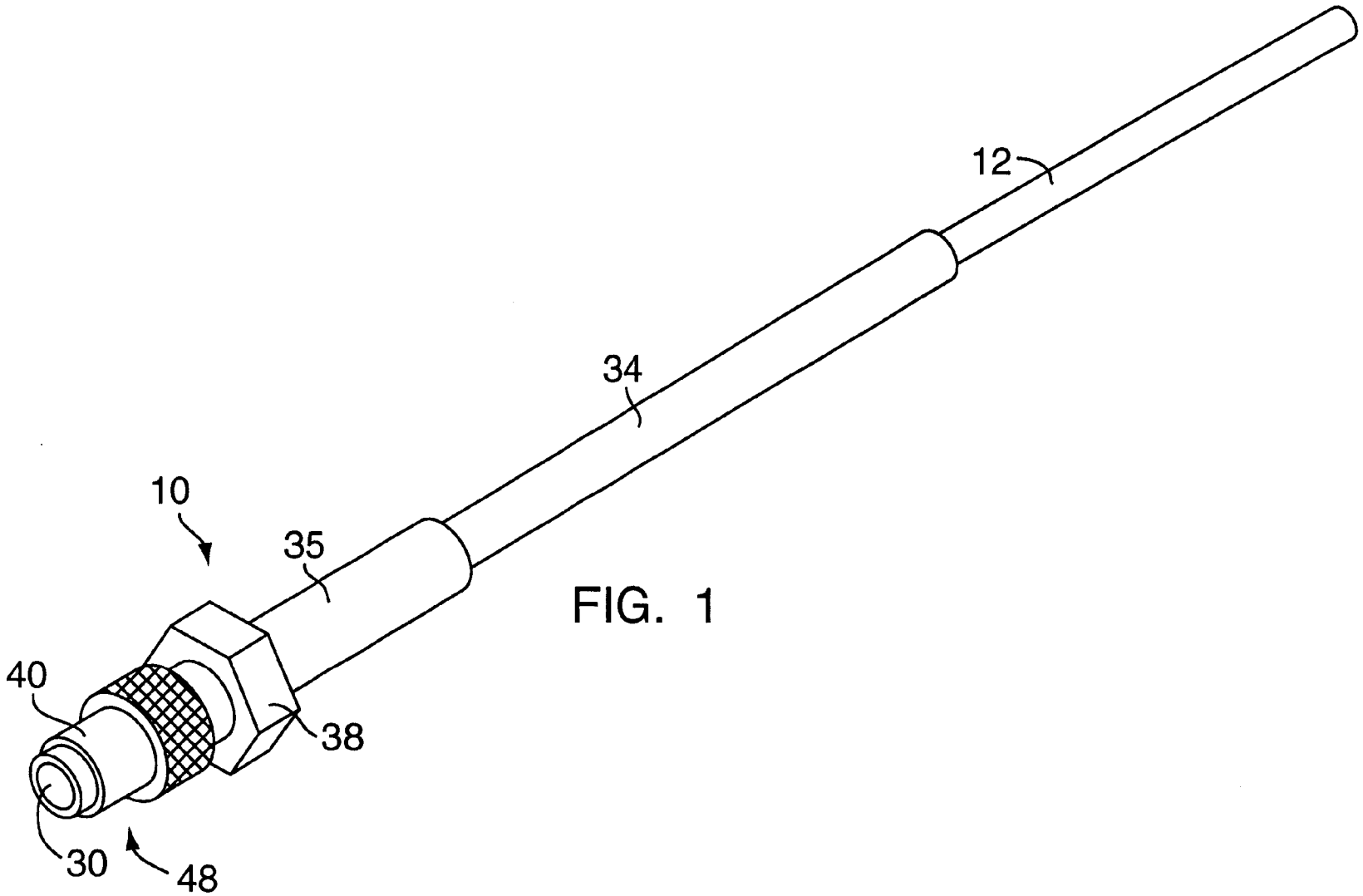
FIG. 1 is a perspective view of an initiator device in accordance with the present invention.
Figure 2:
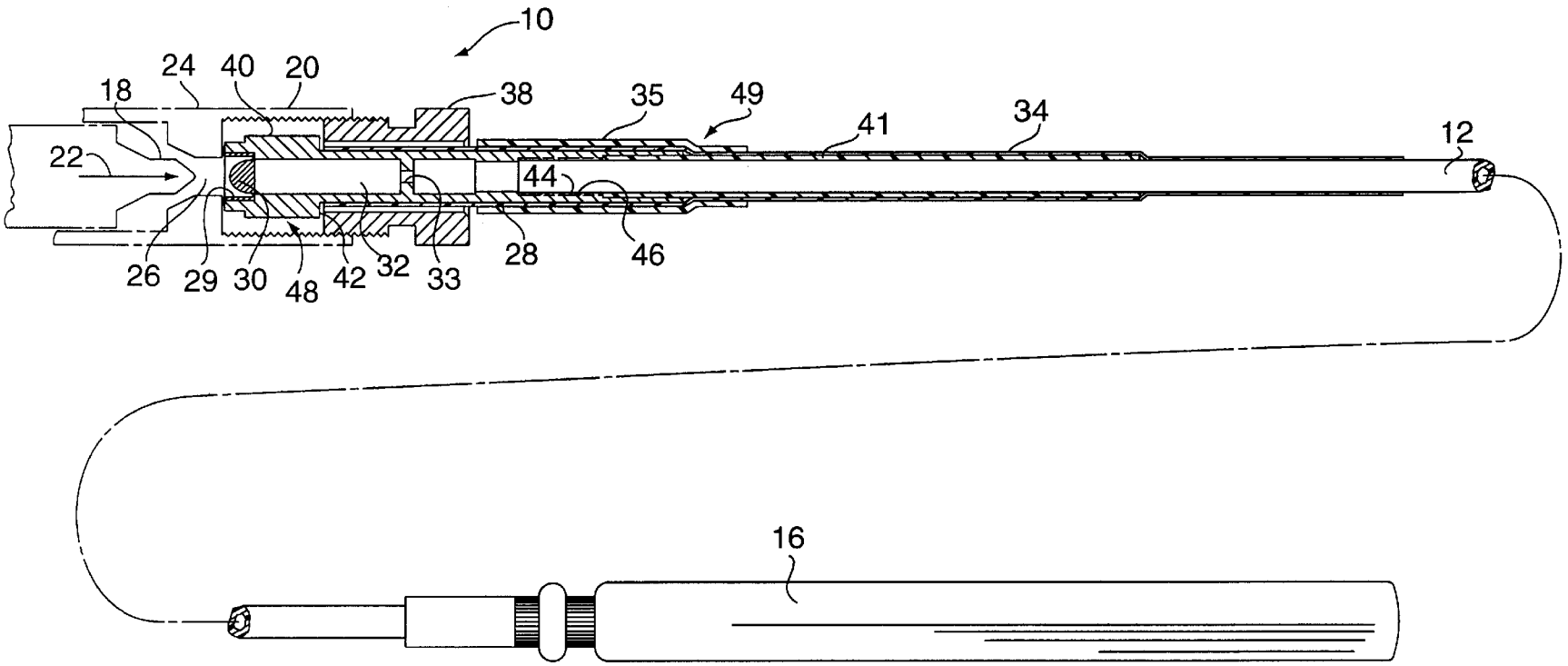
FIG. 2 is a cross-sectional, side elevation view of the initiator device of FIG. 1 coupled to a detonator cap via a shock tube.

With reference to FIGS. 1 and 2, an in-line initiator for generating a shock wave along a shock tube is generally designated by the reference number 10. The in-line initiator 10 is attached to an input end of a signal transmission or shock tube 12. The shock tube 12 is of a conventional type including a plastic tube having an outer abrasion resistant layer and an inner adhesive layer, and having a reactive material adhered to the inner surface thereof. The in-line initiator 10 includes a first or end sleeve 28 defining a longitudinal internal bore. The input end of the shock tube 12 is inserted into the internal bore of the end sleeve 28. The end sleeve 28 is rotatable using a fixture so that internal engagement threads 46 securely grip an outer surface of the shock tube 12 without restricting the internal diameter of the shock tube. A second or outer protective sleeve 34 including a length of heat shrinkable tubing may be slid along and partially overlap the outer surface of the end sleeve 28 and the shock tube 12, and then be heat activated to reliably grip and provide a hermetic seal about the shock tube 12 and provide water resistance to the assembly. In particular, the protective sleeve 34 provides the hermetic seal at the interface of the shock tube 12 with the end sleeve 28 of the in-line initiator 10. The outer protective sleeve 34 provides improved abrasion resistance and water resistance to the in-line initiator assembly. In a preferred embodiment of this invention, the outer protective sleeve 34 is a heat shrinkable tubing, such as Raychem DWP-125 shrink tubing. This is an adhesive lined polyolefin tubing with medium wall thickness. The internal surface of this shrink tubing is coated with an adhesive to securely grip the shock tube 12 and provide enhanced pullout strength.

A retaining means 38 is positioned about an outer surface of the outer protective sleeve 34 for securing the in-line initiator 10 at its input end to a percussion firing device or triggering device 20 defining a central aperture 26. As shown in FIGS. 1 and 2, the retaining means 38 may be an externally threaded retaining nut defining a longitudinal internal aperture receiving the outer protective sleeve 34. The retaining nut 38 is rotatable freely about the portion of the end sleeve 28 overlapped by the outer protective sleeve 34, and is threadably engageable into the percussion firing device 20 without having to rotate the end sleeve 28 or the signal transmission tube 12. The end sleeve 28 has a collar 40 at an input end 48 that defines a shoulder stop 42 against which the retaining nut 38 may bear. Thus when the retaining means 38 is threaded into the triggering device 20, the input end 48 of the end sleeve 28 is secured against the central aperture 26 defined by the triggering device for positioning a primer cap 30 to be detonated.

The internal bore of the end sleeve 28 includes a diametrically enlarged portion or pocket 29 at its input 48 for receiving an initiating charge, which is preferably self-contained, such as the primer cap 30. Preferably, the pocket 29 at the input end 48 of the end sleeve 28 provides a friction fit for the primer cap 30. When the primer cap 30 is properly positioned within the pocket 29, the input end 48 of the sleeve 28 is hermetically sealable by applying a coating of varnish or similar sealant to the outer surface of the in-line initiator 10.

The internal structure of the in-line initiator 10 is shown in greater detail in FIG. 2 where it is attached to the percussion firing device or triggering device 20. The percussion firing device 20 may be a spring-loaded flare gun such as a MK-31 signal projector. Such devices include a striking pin 18 which is moveable within a barrel 24 and which is spring loaded to move in the direction of arrow 22 when the spring tension is released. As illustrated in FIG. 2, the striking pin 18 passes through the central aperture 26 defined by the triggering device 20 to impact the primer cap 30 such that the mechanical force of the impact defined by the triggering device 20 initiates the primer cap.

The internal bore of the end sleeve 28 includes a pressure chamber 32 located adjacent to and downstream of the primer pocket 29 relative to percussive signal movement to contain the energy released by the detonation of the primer cap 30. The internal bore of the end sleeve 28 includes a diametrically reduced flash hole 33 at an output end of the pressure chamber 32 to facilitate the initiation energy generated from the detonated primer cap 30 to be focused into and along the interior of the shock tube 12. By transferring and focusing the energy released by the detonation of the primer cap 30, the reactive material disposed within the shock tube 12 is initiated to generate a percussive signal therealong.

An output end 49 of the end sleeve 28 receives the shock tube 12. The longitudinal bore defined by the end sleeve 28 includes an internally threaded portion for threadably receiving the input end of the shock tube 12 inside the end sleeve. The shock tube 12 need not be threaded, but the outer polymeric coating is preferably fabricated from a material that will allow the end sleeve 28 to be forcibly threaded upon assembly. Examples of such materials are polyolefins, nylons and nylon copolymers. In a preferred embodiment, PEBAX 6333, a nylon copolymer manufactured by Elf Atochem, is the outer polymeric sleeve.

When the end sleeve 28 is properly threaded onto the shock tube 12 as described, the pullout strength of the shock tube approaches its ultimate breaking strength. High pullout strength is important in field applications where the shock tube 12 is subjected to severe pulls. As additional means for reinforcing the attachment of the shock tube 12 to the end sleeve 28, a small quantity of adhesive 44 may be applied to the outer surface of the shock tube prior to threadably engaging the end sleeve onto the shock tube. The adhesive 44 prevents the end sleeve 28 from disengaging from the shock tube 12 and provides improved water resistance to the overall assembly. As an example of the adhesive 44, Loctite @404, a cyanoacrylate ester adhesive, may be used to secure the end sleeve 28 with the shock tube 12.

By securing the end sleeve 28 to the shock tube 12 in the above described manner, the internal bore of the shock tube 12 is unchanged in diameter or cross-sectional area, the diminishment of which would otherwise impede the transmission of a percussive signal therealong. Previous assemblies crimp the sleeve onto the shock tube. Crimping places severe restrictions on the inner diameter of the shock tube. These restrictions make it extremely difficult to initiate the shock tube and in the worst instance, initiation failures may result.

It may be desirable to provide additional reinforcement to the shock tube 12 along its length where the shock tube interfaces with the end sleeve 28. FIG. 2 illustrates such a reinforcing member 41 applied about the shock tube 12. The reinforcing member 41 provides additional hoop strength to the shock tube 12 along the portion of the shock tube that is attached to the end sleeve 28. Such reinforcement minimizes the possibility of the shock tube 12 rupturing at the point of initiation. Preferably, HS-105 ⅛" PVC shrink tubing is used as the reinforcing member 41.

Optionally, an additional length of heat shrinkable tubing may extend about a portion of the outer protective sleeve 34 as a strain relief member 35. The strain relief member 35 extends about at least the portion of the outer protective sleeve 34 covering the interface of the end sleeve 28 with the shock tube 12. The strain relief member 35 provides additional abrasion resistance to the in-line initiator 10 and also serves as a stop means to limit the longitudinal travel of the retaining means or nut 38. The heat shrinkable tubing further provides a smooth exterior to facilitate mounting the in-line initiator 10 into mechanical firing devices such as the MK 54 adapter. The heat shrinkable tubing also provides a snug, friction fit of the in-line initiator 10 to the adapter and holds the in-line initiator in close alignment with the firing device.

As shown in FIG. 2, the shock tube 12 has the in-line initiator 10 attached to its input end and a detonator cap 16 fixedly attached to the output end. The detonator cap 16 contains an explosive charge that is readily ignited by the shock tube 12 and has sufficient explosive output to initiate a main explosive charge, such as Comp C-4, or ignite a pyrotechnic device such as a rocket motor or automotive airbag. The detonator cap 16 is shown crimped onto the shock tube 12 to provide a hermetic seal at the output end of the shock tube. The detonator cap 16 may be any conventional type of blasting cap such as a miniature detonating cap or a full strength detonator for direct initiation of insensitive explosives. Thus, the present invention as shown in FIGS. 1 and 2 provides a self-contained detonating device with an in-line initiator at one end and a detonator at the other end. Depending on the application, the length of the shock tube 12 may be varied to insure that the initiation at the input end of the shock tube 12 is at a safe distance from the main explosive charge at the output end of the shock tube.

An advantage of the present invention is that the in-line initiator 10 need not be integrally incorporated onto the input end of the signal transmission tube 12. Rather, the in-line initiator 10 may be prepared with a self-contained initiation charge such as the primer cap 30 mounted in the pocket 29 of the end sleeve 28. The end sleeve 28 may then at some later time be threadably engaged with the signal transmission tube 12 in a field location so as to provide maximum flexibility to the end user.

Figure 3A:
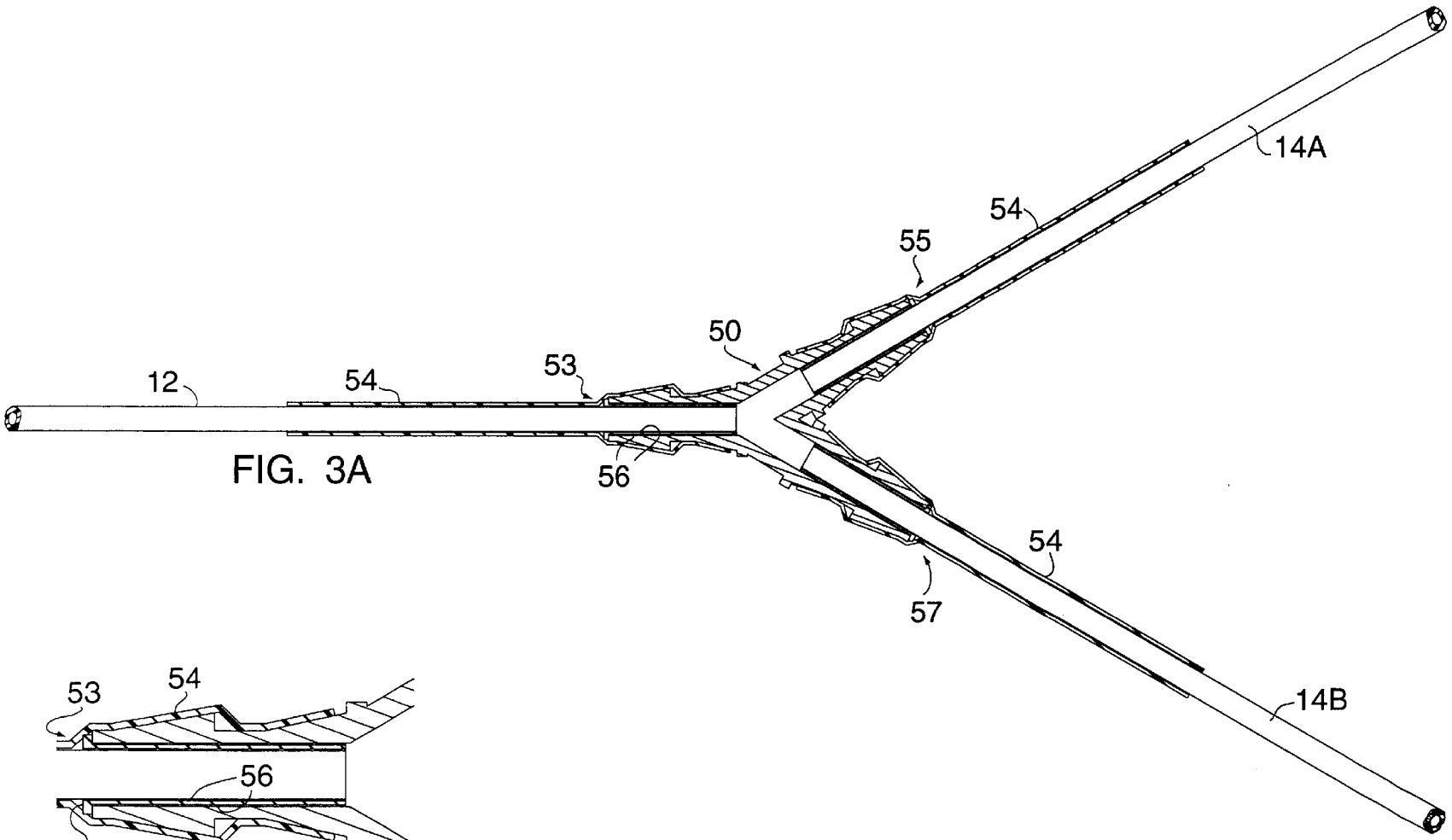
FIG. 3A is a cross-sectional view of a shock tube signal splitter in accordance with the present invention.
Figure 3B:
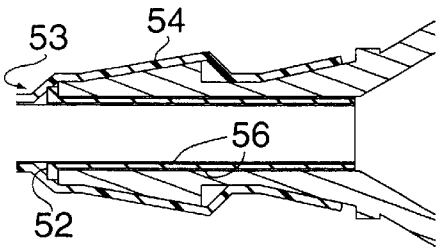
FIG. 3B is an enlarged, cross-sectional view of a portion of the shock tube signal splitter of FIG. 3A.

DETAILED DESCRIPTION OF THE SIGNAL SPLITTER (FIGS. 3A and 3B)

For some applications, it is advantageous to have multiple outputs of the shock tube for a single input in order to fire several devices. Providing a single input and multiple outputs is accomplished with a signal splitter connector 50 which may be, for example, a T-connector or a Y-connector. As best shown in FIG. 3A, a Y-connector 50 has an input end 53 for receiving an input shock tube 12 and first and second output ends 55, 57 for respectively receiving first and second output shock tubes 14A and 14B. The connector 50 for connecting the input shock tube 12 to the output shock tubes 14A and 14B may be of a durable material such as plastic or metal. In a preferred embodiment, the connector 50 is a 3/16th inch barbed polycarbonate fitting used in pneumatic tubing connections. As best shown in FIG. 3B metal spacers or sleeves 52 provided within receiving apertures of the connector 50 frictionally grip the outer surfaces of the shock tubes 12, 14A, 14B to securably anchor the shock tubes with the connector. An adhesive layer 56 anchors the sleeves 52 to the connector 50 and the shock tubes 12, 14A, 14B. A preferred type of adhesive is Loctite @ Prism 401 adhesive.

To provide additional pullout strength and waterproofness, a third or outer protective sleeve 54 is applied over the barbed end fitting and extends snugly over the leads of the shock tubes 12, 14A, 14B. The sleeve 54 is preferably a heat shrinkable tubing with an adhesive lining. In a preferred embodiment, Raychem DWP-125 adhesive lined heat shrinkable tubing is used. When the signal splitter connector 50 is connected to the shock tubes 12, 14A, 14B, the pullout strength of the shock tubes in the connector is greater than 60% of the breaking strength of the shock tubes. Additionally, the signal splitter connector 50 and the shock tubes 12, 14A, 14B coupled thereto may be held underwater exposed to a pressure of 95 pounds per square inch for a period of two hours and still function.

DETAILED DESCRIPTION OF THE FIRING DEVICE (FIGS. 4 AND 5)

Figure 4:
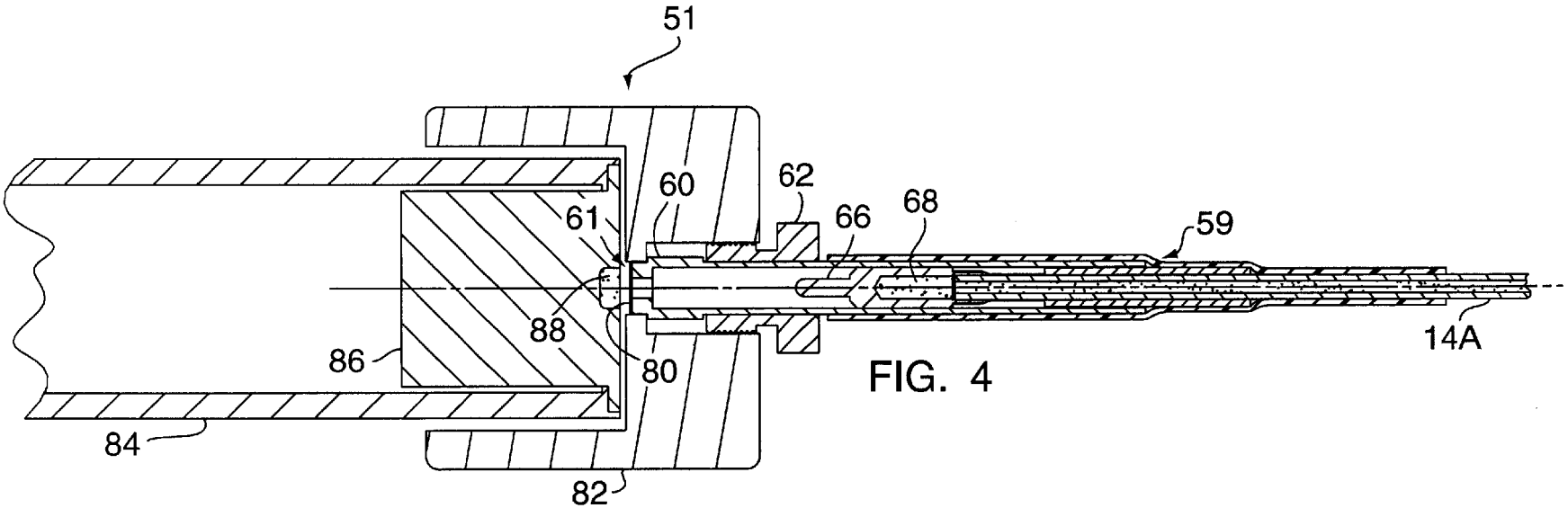
FIG. 4 is a cross-sectional view of a firing device at the output end of the shock tube showing a firing pin piston and the output end being engaged with a disrupter firing device.

As mentioned above, the signal from the shock tube may be used to initiate a detonator. This is common in many ordnance applications. However, there are other applications where it is desirable to fire another device or activate a valve. For these applications, a mechanical output of the shock tube is required. FIG. 4 provides a schematic view of one embodiment of a firing device assembly 51. A metal barrel 60 is provided as an end fitting for a shock tube such as, for example, the shock tube 14A of FIG. 3A. The metal barrel 60 has an input end 59 for securably receiving the shock tube 14A and an output end 61 for securably receiving an output or firing device 51, such as a disrupter firing device.

Figure 5:
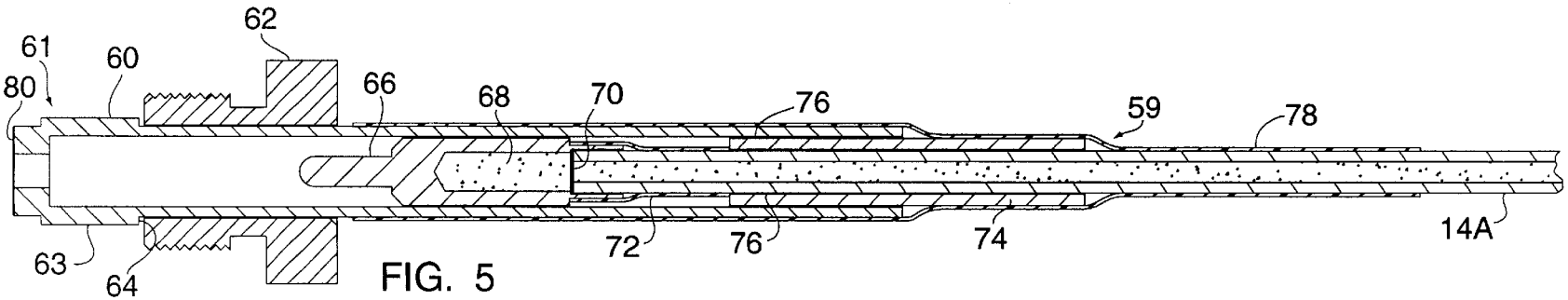
FIG. 5 is an enlarged cross-sectional view of the firing device output end of the shocktube of FIG. 4.

More specifically, a retaining means 62 is positioned about an outer surface of the barrel 60 for securing the barrel at its output end 61 to the firing device 51. As shown in FIGS. 4 and 5, the retaining means 62 may be an externally threaded retaining nut defining a longitudinal internal aperture. The retaining nut 62 is rotatable freely about the barrel 60, and is threadably engageable into the firing device 51 without having to rotate the barrel or the signal transmission tube 14A. The barrel 60 has a collar 63 at its output 61 that defines a shoulder stop 64 against which the retaining nut 62 may bear. Thus when the retaining means 62 is threaded into the firing device 51, the output end 61 of the barrel 60 is secured against a central aperture defined by the firing device for transmitting shock waves from the shock tube 14A to the firing device.

A disrupter head 82 is attached to the output end 61 of the barrel 60. The barrel 60 defines a longitudinal bore extending from its input end 59 to its output end 61, and includes a firing pin piston 66 slidably dispersed in the internal bore of the barrel.

The input end 59 of the metal barrel 60 defines an opening that the firing pin piston 66 may pass through and engage a device such as, for example, a 12 gauge shell 86. As shown in FIG. 4, a 12 gauge shell 86 is inserted into a disrupter barrel 84 which is then secured to the disrupter head 82 by internal threads. The 12 gauge shell has a 209 primer 88 located in the central portion of the shell casing. The output end of the firing device barrel 60 is covered by an aluminum foil disk 80 to provide a hermetic seal on the input end of the firing device 51. This seal is easily punctured by the firing pin piston 66.

A more detailed cross-sectional view of the output device 51 is shown in FIG. 5. At the input end 59 of the barrel 60, a metal spacer 74 securably receives the signal transmission tube or shock tube 14A. The shock tube 14A is positioned inside the spacer 74 and an adhesive layer 76 is applied to the shock tube to adhere the shock tube to the spacer. The internal diameter of the signal transmission tube 14A is not restricted such that the percussive signal transmitted from the shock tube to the output device 51 is not impeded or weakened in intensity. The outer adhesive layer 76 also adheres the spacer 74 to the interior of the barrel 60 at its input end 59. A fourth or outer protective sleeve 78 extending about the shock tube 14A and the output device 51 at the interface of the shock tube 14A with the output device enhances the pullout strength and water resistance of the assembly. One preferred embodiment of the sleeve 78 is Raychem DWP-125 shrink tubing which is an adhesive lined polyolefin tubing. The outer surface of the spacer 74 preferably has a knurled surface to promote adhesion between the outer protective sleeve 78 and the spacer 74.

The slidable firing pin piston 66 defines a cavity in a base of the firing pin piston communicating with the input end 59 of the barrel 60 to receive a propellant charge 68. The propellant charge 68 is initiated by a shock wave signal transmitted from the signal tube 14A and provides a propulsive force to the firing pin piston 66 to pierce the foil 80 and strike the primer 88. Several finely divided pyrotechnic compositions are suitable for this purpose. In a preferred embodiment, a finely divided mixture of metal may be employed for the pyrotechnic composition. Common mixtures are an admixture of aluminum or zirconium with potassium perchlorate. An adhesive lined paper disk 70 may be used to seal the output end of the shock tube 14A with the output device 51 and to provide resistance to humidity and moisture infiltration into the interior of the shock tube and output device.

The firing pin piston 66 is charged with the propellant 68 and attached to the shock tube 14A with a short length of adhesive lined, thin wall, heat shrinkable tubing 72. The tubing 72 holds the firing pin piston 66 securely during transportation and storage. When the shock tube signal ignites the propellant charge 68, the tubing 72 provides a positive restraint until the burning propellant builds up enough pressure to rupture the seal. This provides a greater piston force than if the firing pin piston 66 were allowed to move freely inside the barrel 60. In a preferred embodiment, a 0.45 inch length of thin walled adhesive lined heat shrinkable tubing, 3/16 inch outer diameter, is used to provide a positive location and restraint for the firing pin piston 66.

The barrel 60 contains the entire assembly and also provides a standoff from the tip of the firing pin piston 66 to the foil disk 80. The length of the standoff allows the firing pin piston 66 sufficient distance to accelerate from its rest position during initiation. An example of standoff length found to work adequately is about one inch. During piston movement the propellant 68 continues to burn so as to provide additional momentum to the firing pin piston 66. The standoff thus both increases and modulates the kinetic energy.

DETAILED DESCRIPTION OF THE ASSEMBLY (FIG. 6)

Figure 6:
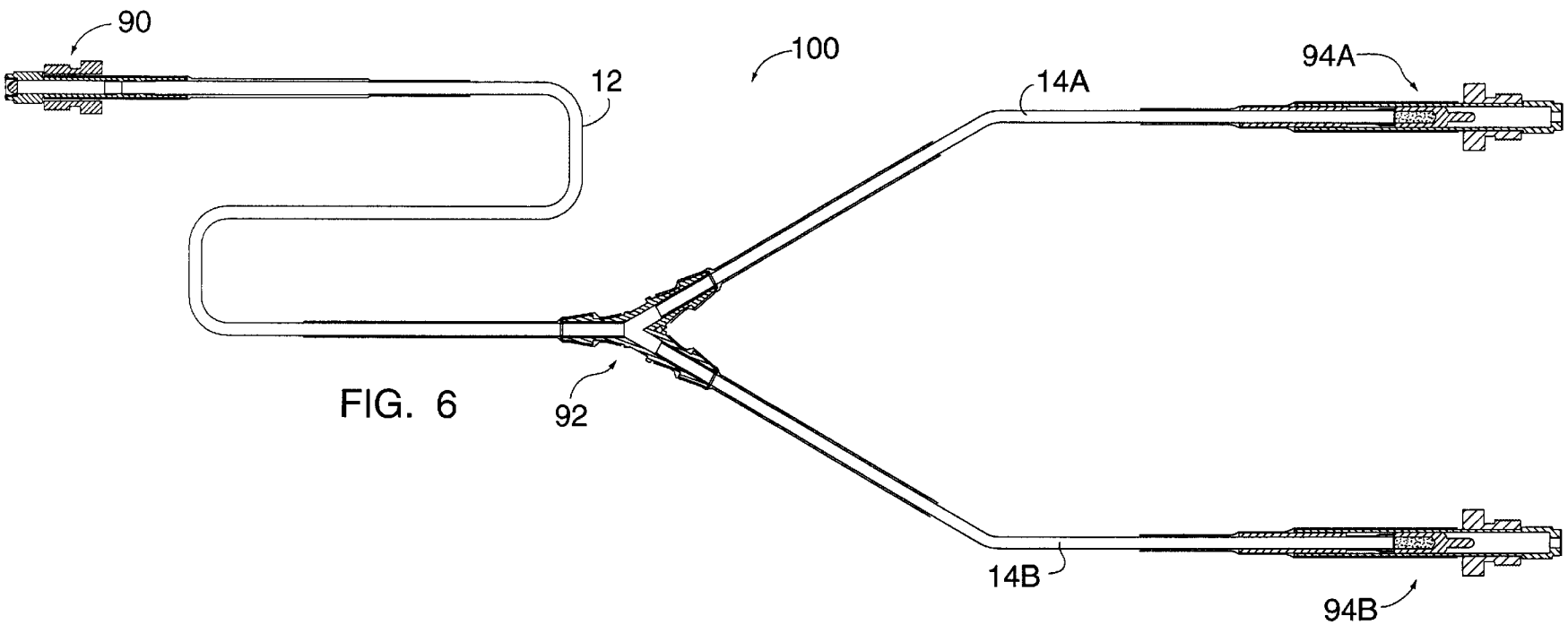
FIG. 6 is a cross-sectional view of an assembly including the initiator device in accordance with the present invention, a Y-shaped signal splitter and a firing device to be detonated.

An in-line initiator and firing device assembly 100 according to an embodiment of the present invention is shown in FIG. 6. The assembly 100 has a single input and dual outputs. An in-line initiator 90 is attached to an input end of a shock tube 12. The length of the shock tube 12 may be varied according to customer requirements. The shock tube 12 is affixed to a Y-shaped, signal splitter connector 92. The signal splitter connector 92 creates two output signals in shock tubes 14A and 14B. The shock tubes 14A and 14B are fixedly attached to firing devices 94A and 94B at output ends. Upon firing of the in-line initiator 90, the shock tubes 12, 14A, 14B transmit a percussive signal or shock wave of sufficient strength to activate the two firing devices 94A, 94B on the output end of the shock tubes 14A and 14B. Thus the invention provides for a self-contained in-line initiator and firing device assembly 100 capable of remote firing of disrupter devices.

Although this invention has been shown and described with respect to exemplary embodiments thereof, it should be understood by those skilled in the art that the foregoing and various other changes, omissions, and additions in the form and detail thereof may be made therein without departing from the spirit and scope of the invention. Accordingly, the present invention has been shown and described by way of illustration rather than limitation.

What is claimed is:

1. An initiator device for generating a shock wave through a shock tube, comprising:

an end sleeve having an inner surface defining a bore extending between input and output ends, at least a portion of the inner surface toward the output end being threaded for threadably receiving and forming threads on an outer surface of a shock tube received within the output end; and retaining means associated with the sleeve for receiving a triggering device and securing the device to the input end of the end sleeve.

2. An initiator device as defined in claim 1, wherein the retaining means includes an externally threaded nut slidably receivable along the outer surface of the sleeve for threadably receiving the triggering device and securing the triggering device to the input end of the end sleeve.

3. An initiator device as defined in claim 1, wherein the bore of the end sleeve includes a pressure chamber for accommodating the transmission of a shock wave therethrough.

4. An initiator device as defined in claim 3, wherein the internal bore of the end sleeve includes a pocket having an enlarged cross-sectional area relative to the pressure chamber, the pocket being located upstream of the pressure chamber relative to shock wave movement for positioning a primer cap to be detonated thereat by the triggering device.

5. An initiator device as defined in claim 3, wherein the internal bore of the end sleeve includes a flash hole having a reduced cross-sectional area relative to the pressure chamber, the flash hole being located downstream of the pressure chamber relative to shock wave movement.

6. A firing device assembly for receiving a shock wave from a shock tube, comprising:

a barrel having an inner surface defining a bore extending between input and output ends, the input end to communicate with a shock tube and the output end to communicate with a firing device;

a firing pin piston movably disposed within the bore of the barrel, the firing pin piston defining a cavity communicating with the input end of the barrel for storing a propellant charge to be initiated by shock waves from the shock tube; and retaining means associated with the barrel for coupling the firing device to the barrel.

7. A firing device assembly as defined in claim 6, wherein the retaining means includes an externally threaded nut slidably receivable along an outer surface of the barrel for threadably receiving and securing the firing device to the output end of the barrel.

8. A firing device assembly as defined in claim 6, further including securing means for temporarily preventing the firing pin piston from moving within the bore of the barrel until the propellant charge builds up sufficient propellant force to move the firing pin piston.

9. A firing device assembly as defined in claim 8, wherein the securing means includes adhesive lined, heat shrinkable tubing coupling the firing pin piston to the inner surface of the barrel defining the bore.

10. A firing device assembly as defined in claim 6, further including seal means disposed at the input end of the barrel for providing a seal on the input end of the firing device until the seal means is punctured by the firing pin piston.

11. A firing device assembly as defined in claim 10, wherein the seal means is an aluminum foil membrane.

12. A firing device assembly as defined in claim 6, further including seal means to be disposed between the cavity of the firing pin piston and an output end of the shock tube for providing a seal between the shock tube and the firing device until the seal means is punctured by shock waves transmitted along the shock tube.

13. A firing device as defined in claim 12, wherein the seal means is a paper membrane.

14. An in-line initiator and firing device assembly, comprising:

a shock tube assembly having an input end and an output end;

an in-line initiator for initiating a shock wave along the shock tube assembly, the in-line initiator including:

an end sleeve having an inner surface defining a bore extending between input and output ends, at least a portion of the inner surface toward the output end being threaded, the output end threadably receiving and forming threads on an outer surface of the input end of the shock tube assembly; and first retaining means associated with the end sleeve for receiving a shock wave triggering device and securing the triggering device to the input end of the end sleeve; and a firing device assembly to be activated by a shock wave, the firing device including:

a barrel having an inner surface defining a bore extending between input and output ends, the input end communicating with the output end of the shock tube assembly and the output end to communicate with a firing device;

a firing pin piston movably disposed within the bore of the barrel, the firing pin piston defining a cavity communicating with the input end of the barrel for storing a propellant charge to be initiated by shock waves transmitted from the shock tube assembly; and second retaining means associated with the barrel for coupling the firing device to the barrel.

15. An in-line initiator and firing device assembly as defined in claim 14, wherein the shock tube assembly includes a connector having an input end and a plurality of output ends, an input shock tube having its input end coupled to the output end of the end sleeve, and its output end coupled to the input end of the connector, and a plurality of output shock tubes each having its input end coupled to an associated output end of the connector and its output end to communicate with an associated firing device.

16. An in-line initiator and firing device assembly as defined in claim 15, wherein the connector has an input end and two output ends.

17. An in-line initiator and firing device assembly as defined in claim 16, wherein the connector is a Y-connector.

18. An in-line initiator and firing device assembly as defined in claim 14, further including a reinforcing member extending about the shock tube assembly at a portion interfacing with the end sleeve.

19. An in-line initiator and firing device assembly as defined in claim 18, wherein the reinforcing member includes heat shrinkable tubing.

20. An in-line initiator and firing device assembly as defined in claim 18, further including a protective sleeve extending about an interface of the shock tube assembly with the end sleeve.

21. An in-line initiator and firing device assembly as defined in claim 20, wherein the protective sleeve includes heat shrinkable tubing.

22. An in-line initiator and firing device assembly as defined in claim 20, further including a strain relief member extending about at least a portion of the protective sleeve covering the interface of the shock tube assembly with the end sleeve.

23. An in-line initiator and firing device assembly as defined in claim 22, wherein the strain relief member includes heat shrinkable tubing.

* * * * *